US011255107B2

(12) United States Patent
Ebreo

(10) Patent No.: US 11,255,107 B2
(45) Date of Patent: Feb. 22, 2022

(54) KEY ENCASEMENT HAVING A COMBINATION LOCK

(71) Applicant: Joshua C. Ebreo, Virginia Beach, VA (US)

(72) Inventor: Joshua C. Ebreo, Virginia Beach, VA (US)

( * ) Notice: Subject to any disclaimer, the term of this patent is extended or adjusted under 35 U.S.C. 154(b) by 196 days.

(21) Appl. No.: 16/458,931

(22) Filed: Jul. 1, 2019

(65) Prior Publication Data

US 2020/0002974 A1 Jan. 2, 2020

Related U.S. Application Data

(60) Provisional application No. 62/692,833, filed on Jul. 1, 2018.

(51) Int. Cl.

| | |
|---|---|
| ***E05B 19/00*** | (2006.01) |
| ***A45C 11/32*** | (2006.01) |
| ***E05B 37/02*** | (2006.01) |

(52) U.S. Cl.

CPC ..... *E05B 19/0082* (2013.01); *A45C 11/328* (2013.01); *E05B 19/0052* (2013.01); *E05B 37/02* (2013.01)

(58) Field of Classification Search

CPC ..... A45C 11/324; A45C 11/328; A44B 15/00; E05B 17/14; E05B 19/005; E05B 19/046; E05B 19/0082; E05B 37/02

USPC ..... 70/424, 426, 398, 399, 320, 322, 323, 70/429, 430, 456 R

See application file for complete search history.

(56) References Cited

U.S. PATENT DOCUMENTS

| | | | | |
|---|---|---|---|---|
| 1,000,962 | A * | 8/1911 | Blais | E05B 13/001 70/426 |
| 2,672,043 | A * | 3/1954 | Folscheid | E05B 19/0005 70/447 |
| 2,790,319 | A * | 4/1957 | Brunner | A45C 11/324 70/456 R |
| 2,995,025 | A | 10/1959 | Toepfer | |
| 3,292,400 | A * | 12/1966 | Merila | A45C 11/328 70/414 |
| 3,427,834 | A * | 2/1969 | Tutino | A45C 11/328 70/414 |
| 3,527,072 | A * | 9/1970 | Demetreon | E05B 19/00 70/414 |
| 3,867,823 | A | 2/1975 | Waltower | |
| 3,979,932 | A | 9/1976 | Piche | |
| 4,037,439 | A | 7/1977 | Youd | |
| 4,615,281 | A | 10/1986 | Gaston | |
| 4,651,544 | A | 3/1987 | Hungerford | |
| 4,662,200 | A * | 5/1987 | Borda | E05B 19/18 70/395 |
| 4,747,282 | A * | 5/1988 | Nyun | E05B 17/16 70/398 |
| 4,838,052 | A | 6/1989 | Williams | |

(Continued)

*Primary Examiner* — Suzanne L Barrett

(74) *Attorney, Agent, or Firm* — Bryce D. Miracle, Esq.

(57) ABSTRACT

In accordance with the invention, a key encasement is provided which enables an authorized user to obtain access to a key shrouded within the encasement by way of a combination lock. The key encasement generally includes a key, a thumb pin connected to the key, a lock assembly including a plurality of rotatable combination dials, and a housing assembly for concealing the key and lock assembly while in a shrouded, locked position.

12 Claims, 7 Drawing Sheets

(56) References Cited

U.S. PATENT DOCUMENTS

| | | | | |
|---|---|---|---|---|
| 5,232,086 | A * | 8/1993 | Montanari | A45C 11/328 206/37.2 |
| 5,768,921 | A | 6/1998 | Hill | |
| 6,122,945 | A * | 9/2000 | Grant | E05B 17/145 292/DIG. 2 |
| 6,209,370 | B1 * | 4/2001 | Larson | E05B 11/00 70/19 |
| 6,460,386 | B1 * | 10/2002 | Watanuki | B60R 25/04 70/408 |
| 7,426,841 | B2 * | 9/2008 | Yang | E05B 19/0005 109/47 |
| 8,011,214 | B2 * | 9/2011 | Katagiri | B60R 7/04 70/252 |
| 8,146,736 | B2 * | 4/2012 | Downes | E05B 19/046 206/37.2 |
| 8,307,677 | B2 | 11/2012 | Larson | |
| 8,418,843 | B2 * | 4/2013 | Palmer | A45C 11/008 206/37.1 |
| 8,966,946 | B2 | 3/2015 | Lai | |
| 9,024,718 | B1 | 5/2015 | Muse | |
| 9,359,792 | B1 | 6/2016 | Liao | |
| 2006/0016231 | A1 * | 1/2006 | Khounsombath | A45C 11/324 70/456 R |
| 2006/0037369 | A1 | 2/2006 | Bright | |
| 2008/0196462 | A1 * | 8/2008 | Beresnitzky | A45C 11/324 70/456 R |
| 2008/0229794 | A1 * | 9/2008 | Fujimoto | E05B 19/046 70/456 R |
| 2011/0016937 | A1 * | 1/2011 | Downes | A45C 11/328 70/393 |
| 2014/0373578 | A1 | 12/2014 | Chang | |

* cited by examiner

KEY ENCASEMENT HAVING A COMBINATION LOCK

CROSS-REFERENCE TO RELATED APPLICATION

This application is based upon and claims the priority filing date of the previously filed, U.S. Provisional patent application entitled "KEY ENCASEMENT HAVING COMBINATION LOCK" filed Jul. 1, 2018, Ser. No. 62/692,833, the entire disclosure of which is hereby incorporated herein by reference.

FIELD OF THE INVENTION

The present invention relates to the field of combination type locks, particularly a combination lock for encasing a key.

BACKGROUND

A key is a device that is used to operate a lock. A typical key is a small piece of metal consisting of two parts: the bit or blade, which slides into the keyway of the lock and distinguishes between different keys, and the bow, which is outward protruding so that torque can be applied by the user. A key is usually intended to operate one specific lock or a small number of locks that are keyed alike, so each lock requires a unique key to lock or unlock. The key serves as a security token for access to the locked area; only persons having the correct key can open the lock and gain access.

Keys provide an inexpensive, though imperfect, method of control for access to physical properties like buildings, vehicles and cupboards or cabinets. As such, keys are an essential feature of modern living, and are common around the world. It is common for people to carry a set of keys needed for daily activities, often linked by a keyring.

However, one of the drawbacks of physical keys is that they can be misplaced, lost, or even stolen—possibly providing unauthorized persons access to locked barriers, such as doors, lock boxes, padlocks, lockers, and even motor vehicles.

For the foregoing reasons, there is a need for an improved key encasement which prohibits the unauthorized use of a key contained therein, even if lost, misplaced, or stolen.

SUMMARY

In accordance with the invention, a key encasement is provided which enables an authorized user to obtain access to a key shrouded within the encasement by way of a combination lock. In a version of the application, the key encasement generally comprises a key having a forward tip end and an aft end; a thumb pin connected to the key; a lock assembly having a longitudinal axis; and a housing assembly for concealing the key and lock assembly therein rendering the key inoperable while in a shrouded, locked position and useful while in an extended, unlocked position.

In a version, the lock assembly generally comprises a slidable pin longitudinally affixed to the aft end of the key along the longitudinal axis, the slidable pin having a plurality of outward extending teeth; and one or more rotatable combination dials aligned along the longitudinal axis and operably mounted to receive and cooperate with the slidable pin and the slidable pin teeth, wherein each dial has an inner bearing for receipt of the slidable pin therethrough and a notch which corresponds to the size and shape of the slidable pin teeth. Each dial comprises a plurality of numbers which are radially exposed outward and correspond to a notch position.

Generally, housing assembly comprises a forward portion having an open-ended shroud for concealing the key while in the shrouded position, the forward portion forming a longitudinal slot for allowing the thumb pin to travel between the shrouded, locked position and the extended, unlocked position; and an aft portion for operably encasing the locking mechanism, the aft portion forming one or more openings corresponding to the one or more rotatable combination dials exposing at least one number per dial.

By way of operation, while the key encasement is in the shrouded position, when a predetermined correct combination of numbers is selectively aligned, the slidable pin and key is releasably slidable relative to the dials permitting movement from the shrouded, locked position to the extended, unlocked position; and when an incorrect combination of numbers is aligned, the slidable key assembly is affixed in the shrouded position relative to the plurality of dials.

In certain versions of the application, the key encasement may further include a ring at the aft end for operably coupling to a keychain.

In other versions, the aft end of the key includes a shoulder having an elevated platform, the key shoulder is configured to limit the travel of the key while in the extended, unlocked position.

In yet another version, the thumb pin is operably positioned perpendicular on the elevated platform and is operably threaded to be attachably removable to and from the elevated platform.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other versions that depart from these specific details. In other instances, detailed descriptions of well-known devices, circuits, and methods are omitted so as not to obscure the description of the present invention with unnecessary detail.

Moreover, the description is not to be taken in the limiting sense but is made merely for the purpose of illustrating the general principles of the invention, since the scope of the invention is best defined by the appended claims. Various inventive features are described below that can each be used independently of one another or in combination with other features.

Unless otherwise defined, all technical terms used herein have the same meaning as commonly understood by one of ordinary skill in the art to which the invention belongs. As used in the specification and the appended claims, the singular forms "a," "an," and "the" include plural references unless the context clearly dictates otherwise. Any reference to "or" herein is intended to encompass "and/or" unless otherwise stated.

Figure 1:
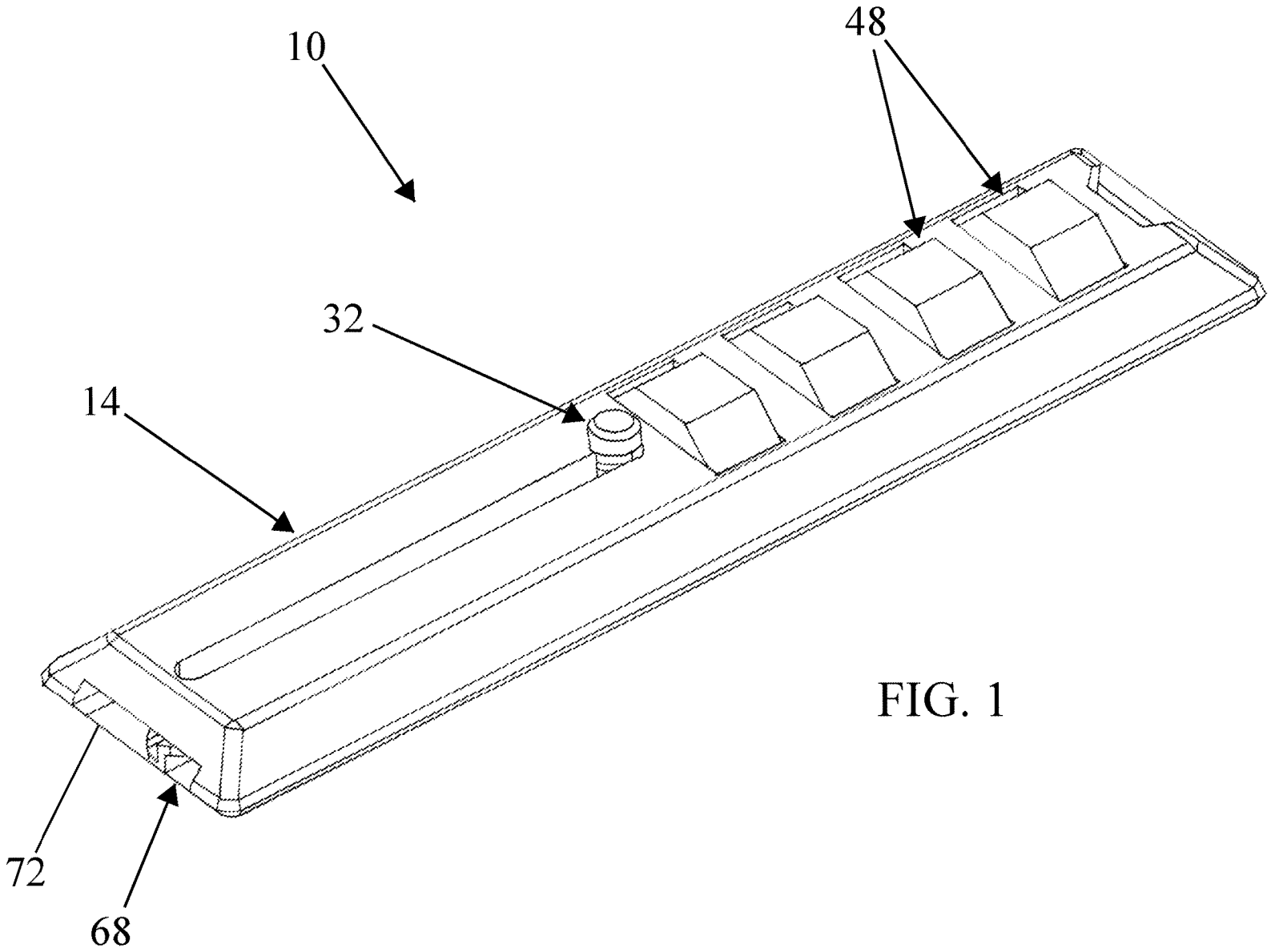
FIG. 1 is a top side perspective view of a version of the application while in the key shrouded position.
Figure 2:
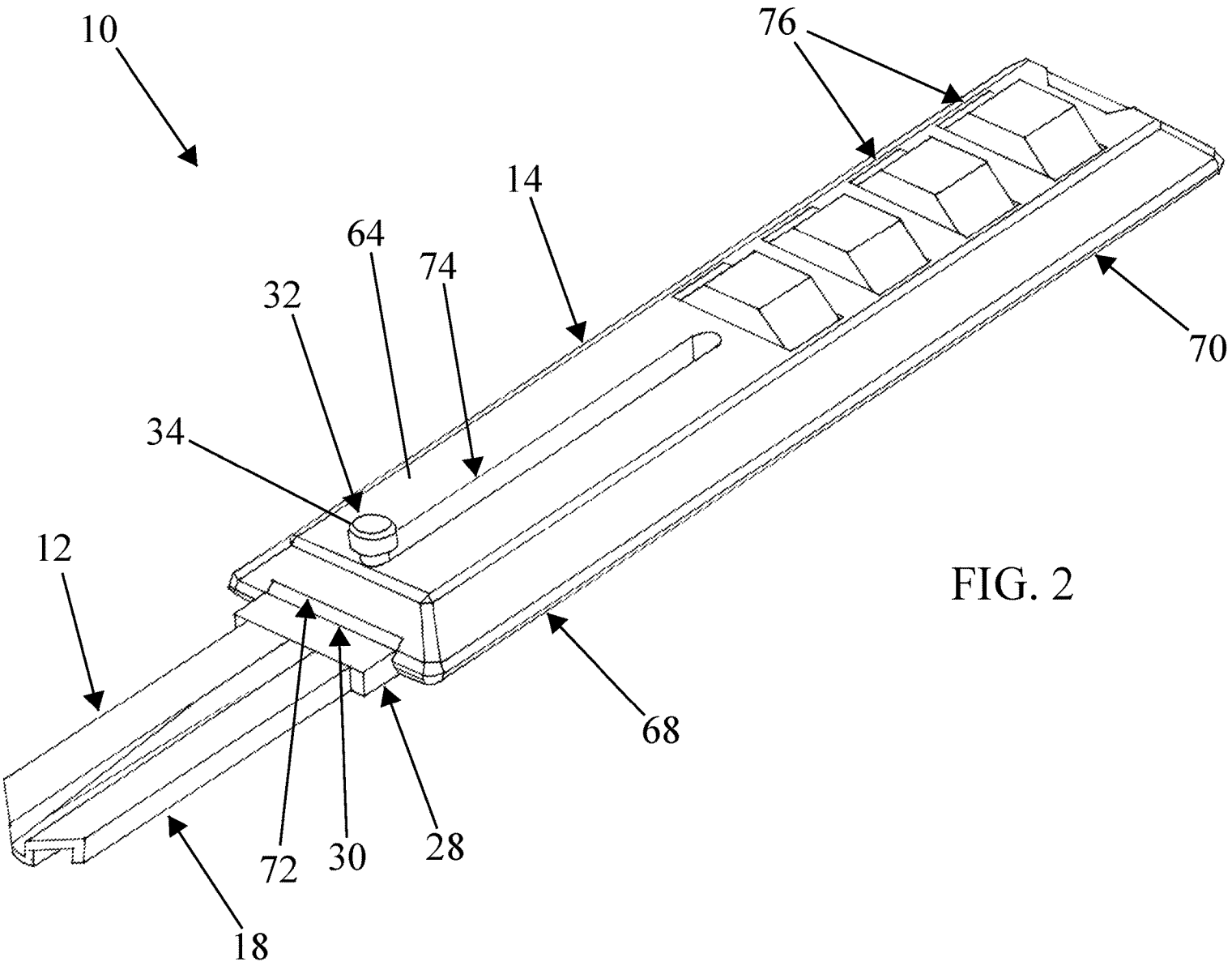
FIG. 2 is a top side perspective view of the version shown in FIG. 1 shown while in the key extended position.

With reference to FIG. 1-FIG. 7, a description of a version of the invention will be provided and is generally designated as numeral 10. Generally, the application is directed towards a key encasement having a combination lock 10. The key encasement having a combination lock 10 is generally configured to conceal a singular key in a shrouded, locked position (FIG. 1) which renders the key inoperable to those without authorization, and upon entry and alignment of a correct combination of numbers, releases the key to an unlocked operable extended position (FIG. 2).

Figure 3:
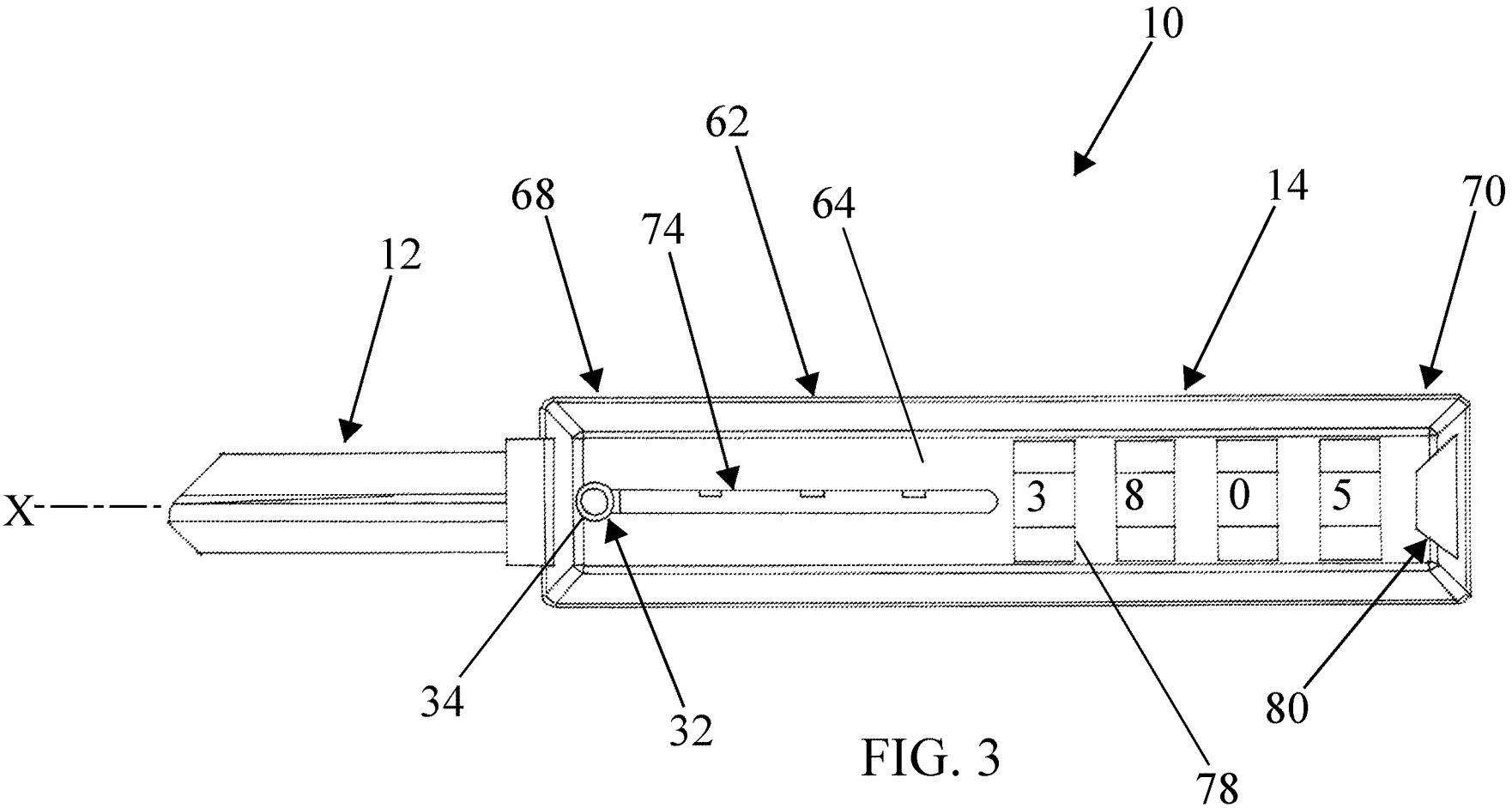
FIG. 3 is a top plan view of the version shown in FIG. 1 shown while in the key extended position.
Figure 4:
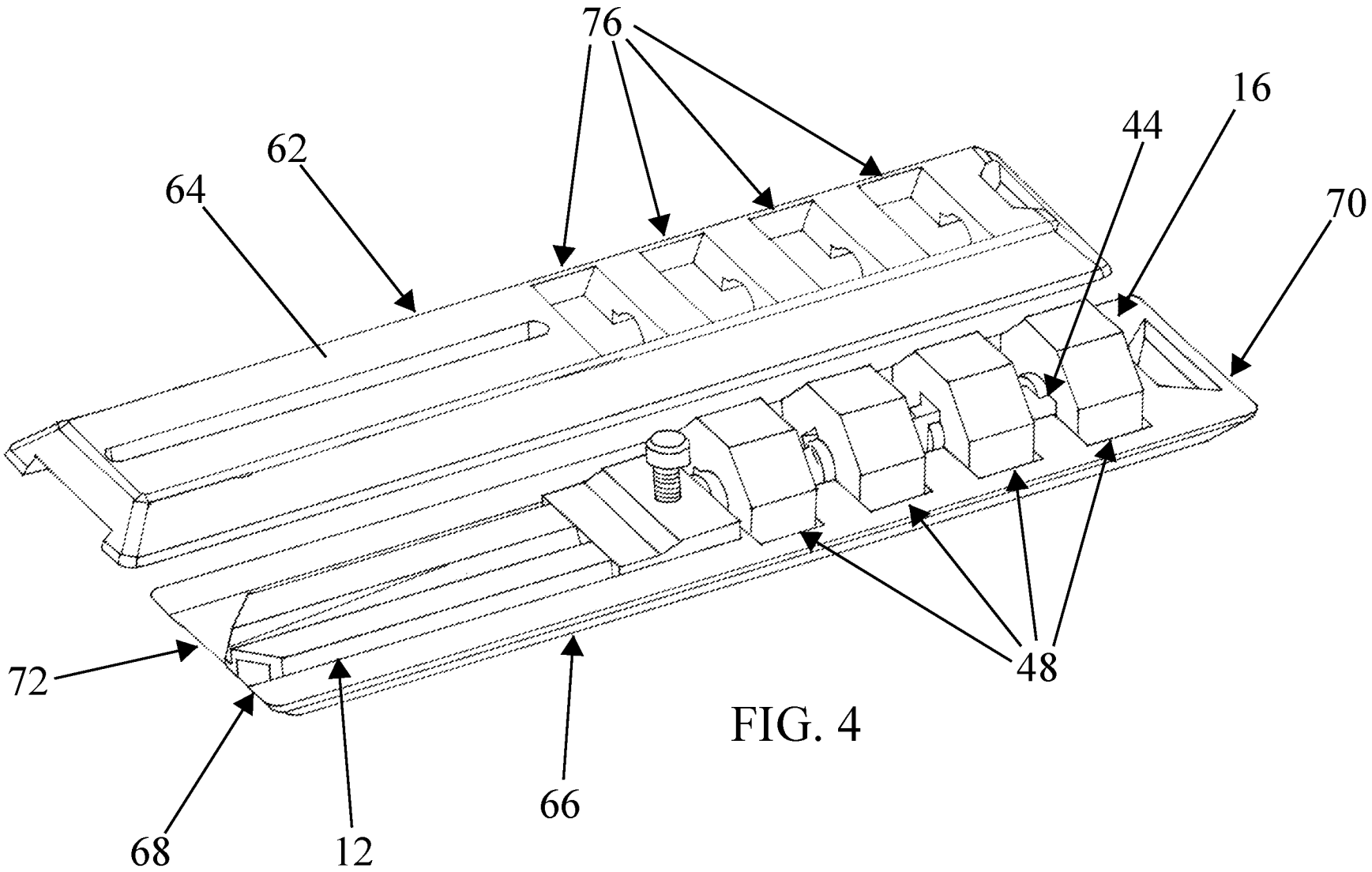
FIG. 4 is an unassembled perspective view of the housing assembly of the version shown in FIG. 1.

With reference to FIG. 1-FIG. 4, in a version of the application, the key encasement having a combination lock 10 generally comprises a key 12, a housing assembly 14, and a lock assembly 16 for locking the key 12 within the housing assembly 14 (see FIG. 4 for lock assembly 16).

Figure 5:
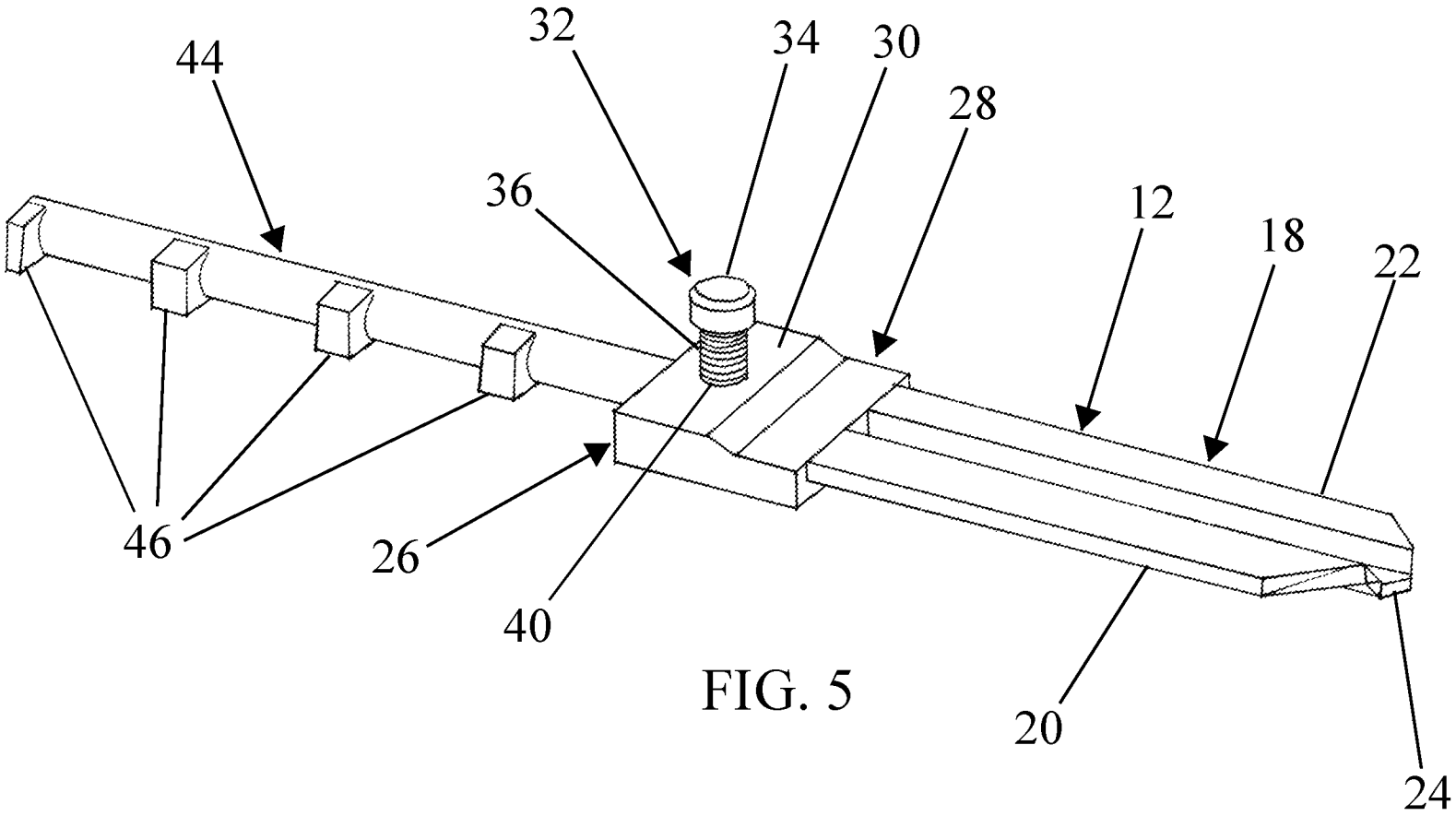
FIG. 5 is a front perspective view showing the slidable pin assembly of the version shown in FIG. 1.

With reference to FIG. 5, the key 12 generally has a blade 18 having a top perimeter 20 and a bottom perimeter 22 extending between a forward tip end 24 and an aft end 26. The top perimeter 20 is operably configured to be cut to form bittings to fit a desired external lock. Ideally, key 12 is manufactured and sold to the consumer as a blank key 12 by default. A shoulder 28 is positioned at the aft end 26 of the key 12 which provides an elevated platform 30 for supporting a removable thumb pin 32. The thumb pin 32 is operably positioned perpendicular relative to the blade 18 above the platform 30 and boasts an enlarged head 34 which enables the user to slide the blade 18 within the housing assembly 14 by way of their thumb between the key shrouded, locked position to the key extended, unlocked position (See FIG. 1 and FIG. 2 respectively). In the illustrated version, the thumb pin 32 is attachably removable by way of external threading 36 which is coupled with a corresponding hole 40 having reciprocal threading 42 embedded within the platform 30 (See FIG. 7).

Figure 6:
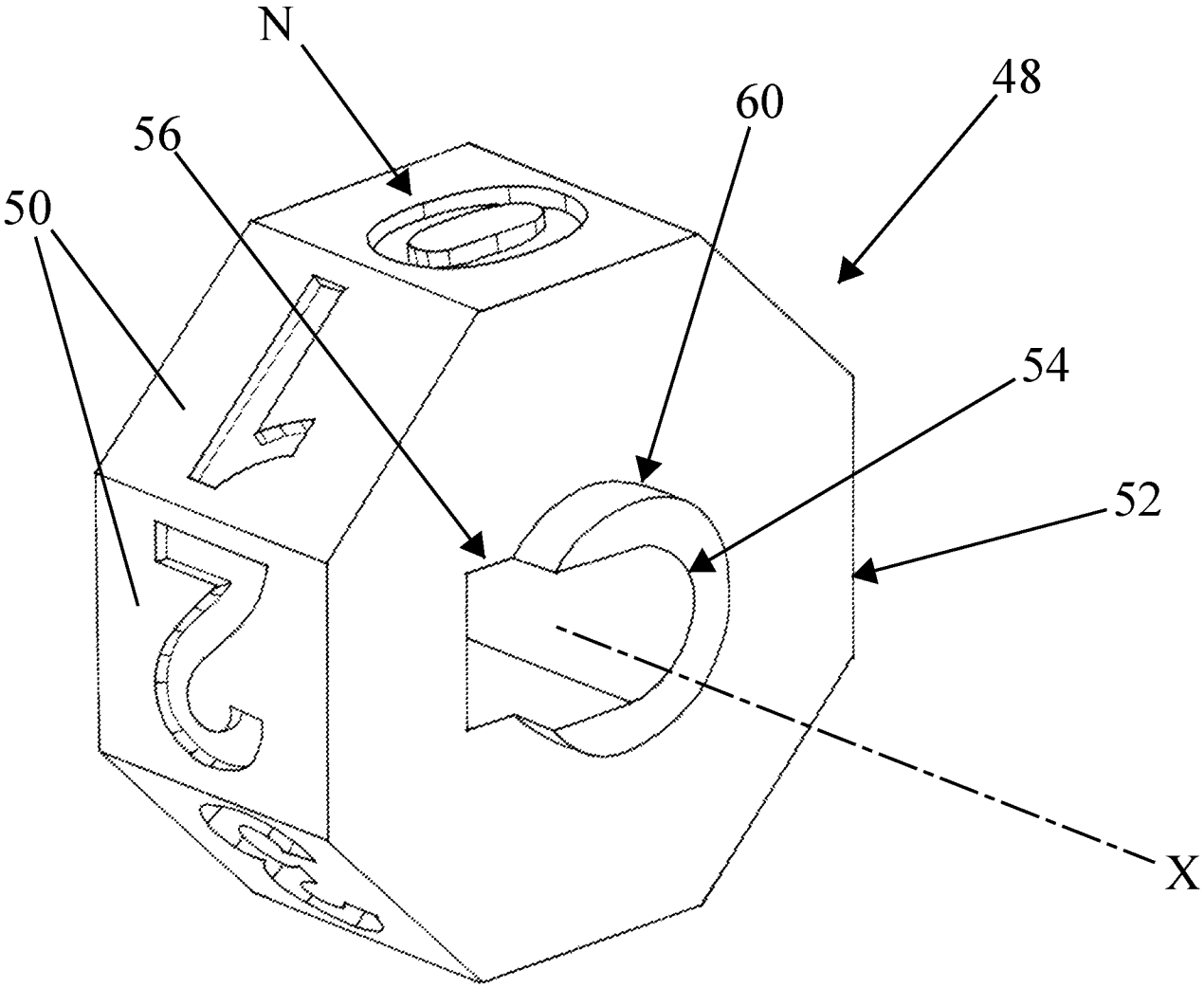
FIG. 6 is an up-close perspective view of the rotatable combination dial.

Referring to FIG. 3-FIG. 7, the lock assembly 16 generally includes a longitudinal axis X, a slidable pin 44 having a plurality of outward extending teeth 46 (See FIG. 5), and a plurality of rotatable combination dials 48 (See FIG. 6). In the version, the slidable pin 44 is affixed to the aft end 26 and the platform 30 of the key 12 along the longitudinal axis X. Therefore, the key 12 and the slidable pin 44 are configured to slidably translate as a unitary piece within the housing assembly 14.

The plurality of rotatable combination dials 48 are linearly aligned along the longitudinal axis X, and operably mounted to receive and cooperate with the slidable pin 44 and the pin teeth 46. Referring to FIG. 6, each of the rotatable combination dials 48 generally comprise a plurality of number facets 50 radially exposed on the outer surface, a dial wall 52 having a bearing 54 for receipt of the pin 44 therethrough and a singular radial notch 56. The radial notch 56 is operably configured and sized to correspond with profile of the pin teeth 46. The correct combination number N appearing on a facet 50 for each rotatable combination dial 48 corresponds with the proper radial notch 56 orientation which releases the slidable pin 44 and key 12 from the shrouded, locked position to the extended, unlocked position. For example, in the version, the radial notch 56 is positioned 90 degrees from the correct number zero N appearing on the dial 48. Moreover, spacers 60 may be provided axially on each side of each dial 48 in order to provide stability and spacing therebetween while mounted on the pin 44.

Figure 7:
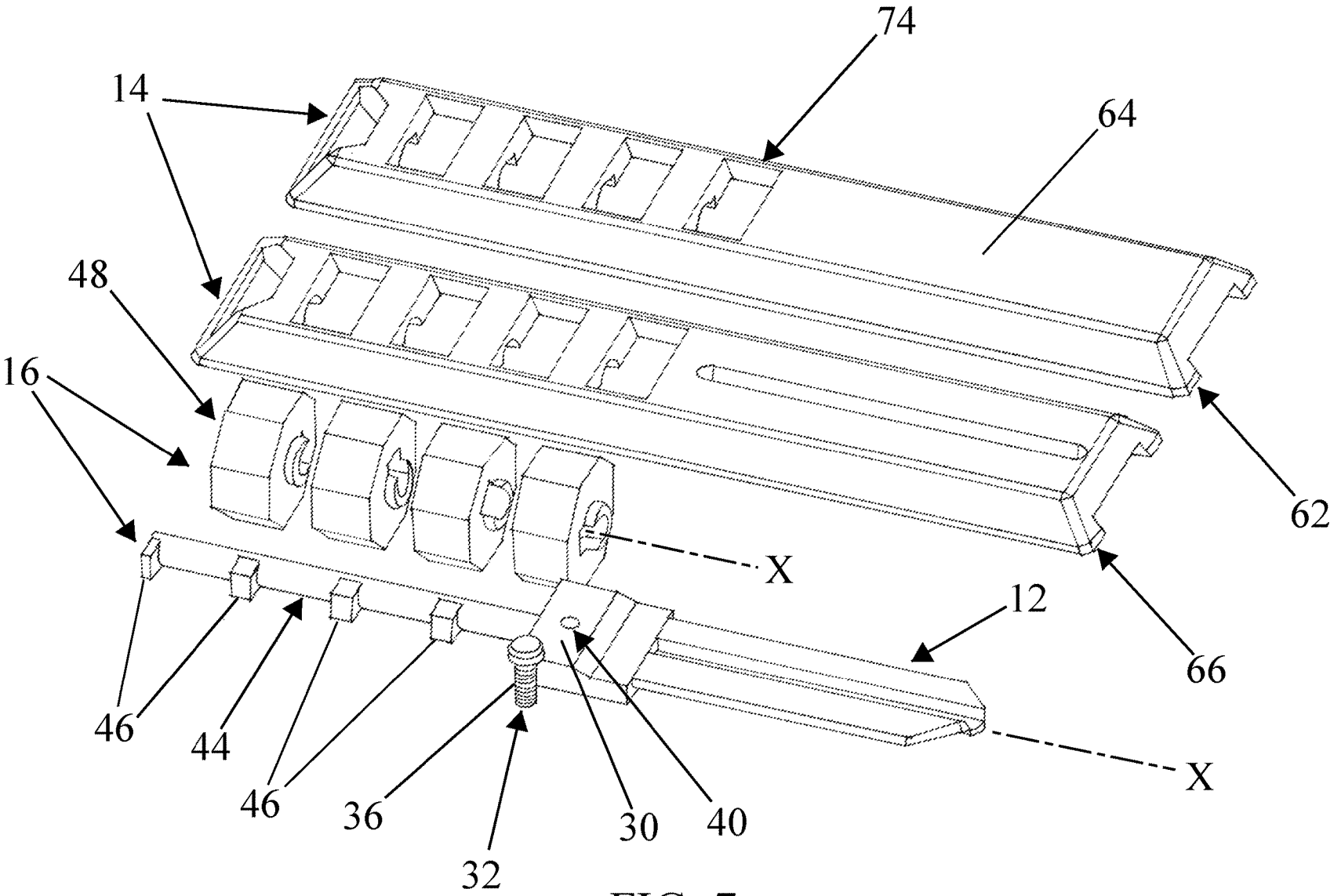
FIG. 7 is an unassembled view of the version shown in FIG. 1.

Referring now to the housing assembly as best shown in FIG. 3, FIG. 4, and FIG. 7, the housing assembly 14 generally comprises a top plate 62 having a top face 64 and a bottom plate 66. The top and bottom plates 62, 66 form together a space for concealing the key 12 and lock assembly 16 therein rendering the key 12 inoperable while in a shrouded, locked position (FIG. 1) and useful while in the extended, unlocked position (FIG. 2). In the version, the top plate 62 and face 64 provide limited access to the key 12 contained within a forward portion 68 and the plurality of rotatable combination dials 48 contained within an aft portion 70. The forward portion 68 generally forming an open-ended shroud 72 (See FIG. 1) for concealing the key 12 while in the shrouded position.

Now referring to FIG. 3-FIG. 7, in the version, the top face 64 of the forward portion 68 provides a longitudinal slot 74 which is sized and configured to allow the thumb pin 32 enlarged head 34 to travel freely exterior of the housing assembly 14 between the shrouded position and the extended position. The aft portion 70 is operably configured to house and encase the locking mechanism 16—thereby preventing unauthorized tampering thereof. The top face 64 of the aft portion 70 provides openings 76 that are tailored to allow exposure of a limited portion of the rotatable combination dials 48 so that the desired numbers can be rotatably selected in order to lock or unlock the key encasement 10.

Therefore, throughout operation of the key encasement having a combination lock 10, when the correct combination of number N on facets 50 are selectively exposed upward (FIG. 3), each of the dial 48 notches 56 align with the linear alignment of the teeth 46 so that the slidable pin 44 can be released from the dials 48 and translate within the housing assembly 14, thereby moving the key blade 18 from the shrouded, locked position to the extended, unlocked position. The key shoulder 28 raised platform 30 is designed to limit the travel to the extended position by contacting with the open-ended shroud 72 (See FIG. 2). Conversely, when the incorrect combination of numbers is selected and aligned, each of the dial 48 notches 56 do not align with the linear alignment of the teeth 46, thus preventing translation of the slidable pin 44—locking the key 12 and blade 18 in the shrouded, locked position within the housing assembly 14. While in the locked, shrouded position, one or more of the rotatable combination dials 48 wall 52 aft surfaces 78 act to prevent one or more of the teeth 46 of the slidable pin 44 from translating forward and disengaging from the lock assembly 16 (See FIG. 3 and FIG. 7).

In certain embodiments, the key encasement having a combination lock 10 may further include a ring 80 at the aft portion 70 for operably coupling to a keychain. If the thumb pin 32 is removed from the raised platform 30, the key 12 and slidable pin 44 may be removed from the housing assembly 14 by way of the open-ended shroud 72.

The key encasement 10 can be made in any manner and of any material chosen with sound engineering judgment. Preferably, materials will be strong, lightweight, long-lasting, economic, ergonomic, and buoyant. Preferably, the housing is made of aluminum, stainless steel, and/or titanium to provide a strong tamper resistant structure.

The invention does not require that all the advantageous features and all the advantages need to be incorporated into every version of the invention.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A key encasement for concealing a key in a locked position comprising:

a key having a forward tip end and an aft end;

a thumb pin connected to the key;

a lock assembly having a longitudinal axis, the lock assembly comprising:

a slidable pin longitudinally affixed to the aft end of the key along the longitudinal axis, the slidable pin having a plurality of outward extending teeth; and one or more rotatable combination dials aligned along the longitudinal axis and operably mounted to receive and cooperate with the slidable pin and the outward extending teeth, wherein each dial has an inner bearing for receipt of the slidable pin therethrough and a notch which corresponds to the size and shape of the slidable pin teeth; each dial comprises a plurality of numbers radially exposed outward and correspond to a notch position; and a housing assembly for concealing the key and lock assembly therein rendering the key inoperable while in a shrouded, locked position and useful while in an extended, unlocked position, the housing assembly comprising:

a forward portion having an open-ended shroud for concealing the key while in the shrouded position, the forward portion forming a longitudinal slot for allowing the thumb pin to travel between the shrouded position and the extended position; and an aft portion for operably encasing the locking mechanism, the aft portion forming one or more openings corresponding to the one or more rotatable combination dials exposing at least one number per dial;

wherein while in the shrouded position, when a predetermined combination of numbers is selectively aligned, the slidable pin and key is releasably slidable relative to the dials permitting movement from the shrouded position to the extended position; and when an incorrect combination of numbers is aligned, the slidable key assembly is affixed in the shrouded position relative to the plurality of dials.

2. The key encasement of claim 1, further comprising a ring at the aft end for operably coupling to a keychain.

3. The key encasement of claim 1, wherein the aft end of the key having a shoulder having an elevated platform, the key shoulder limiting travel while moving to the extended, unlocked position.

4. The encasement of claim 3, wherein the thumb pin is operably positioned perpendicular on the elevated platform.

5. The encasement of claim 4, wherein the thumb pin is operably threaded to be attachably removable to and from the elevated platform.

6. The encasement of claim 5, wherein the thumb pin further comprises an integral enlarged head portion.

7. A key encasement for concealing a key in a locked position comprising:

a key having a forward tip end and an aft end, the aft end having a shoulder having an elevated platform;

a thumb pin connected to the key;

a lock assembly having a longitudinal axis, the lock assembly comprising:

a slidable pin longitudinally affixed to the aft end of the key along the longitudinal axis, the slidable pin having a plurality of outward extending teeth; and one or more rotatable combination dials aligned along the longitudinal axis and operably mounted to receive and cooperate with the slidable pin and the outward extending teeth, wherein each dial has an inner bearing for receipt of the slidable pin therethrough and a notch which corresponds to the size and shape of the outward extending teeth; each dial comprises a plurality of numbers radially exposed outward and correspond to a notch position; and a housing assembly for concealing the key and lock assembly therein rendering the key inoperable while in a shrouded, locked position and useful while in an extended, unlocked position, the housing assembly comprising:

a forward portion having an open-ended shroud for concealing the key while in the shrouded position, the forward portion forming a longitudinal slot for allowing the thumb pin to travel between the shrouded position and the extended position; and an aft portion for operably encasing the locking mechanism, the aft portion forming one or more openings corresponding to the one or more rotatable combination dials exposing at least one number per dial;

wherein while in the shrouded position, when a predetermined combination of numbers is selectively aligned, the slidable pin and key is releasably slidable relative to the dials permitting movement from the shrouded position to the extended position, the key shoulder limiting travel to the extended position; and when an incorrect combination of numbers is aligned, the slidable key assembly is affixed in the shrouded position relative to the plurality of dials.

8. The key encasement of claim 7, further comprising a ring at the aft end for operably coupling to a keychain.

9. The encasement of claim 8, wherein the thumb pin is operably positioned perpendicular on the elevated platform.

10. The encasement of claim 9, wherein the thumb pin is operably threaded to be attachably removable to and from the elevated platform.

11. The encasement of claim 10, wherein the thumb pin further comprises an integral enlarged head portion.

12. A key encasement for concealing a key in a locked position comprising:

a key having a forward tip end and an aft end, the aft end having a shoulder having an elevated platform;

a thumb pin connected to the key;

a lock assembly having a longitudinal axis, the lock assembly comprising:

a slidable pin longitudinally affixed to the aft end of the key along the longitudinal axis, the slidable pin having a plurality of outward extending teeth; and one or more rotatable combination dials aligned along the longitudinal axis and operably mounted to receive and cooperate with the slidable pin and the outward extending teeth, wherein each dial has an inner bearing for receipt of the slidable pin therethrough and a notch which corresponds to the size and shape of the outward extending teeth; each dial comprises a plurality of numbers radially exposed outward and correspond to a notch position; and a housing assembly having a top face, the housing assembly operably concealing the key and lock assembly therein rendering the key inoperable while in a shrouded, locked position and useful while in an extended, unlocked position, the housing assembly comprising:

a forward portion having an open-ended shroud for concealing the key while in the shrouded position, the forward portion top face forming a longitudinal slot for allowing the thumb pin to travel between the shrouded position and the extended position; and an aft portion for operably encasing the locking mechanism, the aft portion top face forming one or more openings corresponding to the one or more rotatable combination dials exposing at least one number per dial;

wherein while in the shrouded position, when a predetermined combination of numbers is selectively aligned, the slidable pin and key is releasably slidable relative to the dials permitting movement from the shrouded position to the extended position, the key shoulder limiting travel to the extended position; and when an incorrect combination of numbers is aligned, the slidable key assembly is affixed in the shrouded position relative to the plurality of dials.

* * * * *